US007955048B2

(12) United States Patent
Lord et al.

(10) Patent No.: US 7,955,048 B2
(45) Date of Patent: Jun. 7, 2011

(54) STEAM TURBINES

(75) Inventors: Martin Robert Lord, Rugby (GB); Philip David Hemsley, Rugby (GB)

(73) Assignee: Alstom Technology Ltd., Baden (CH)

( * ) Notice: Subject to any disclaimer, the term of this patent is extended or adjusted under 35 U.S.C. 154(b) by 72 days.

(21) Appl. No.: 12/391,455

(22) Filed: Feb. 24, 2009

(65) Prior Publication Data

US 2009/0175722 A1 Jul. 9, 2009

Related U.S. Application Data

(63) Continuation of application No. PCT/EP2007/058772, filed on Aug. 23, 2007.

(30) Foreign Application Priority Data

Aug. 25, 2006 (GB) ..... 0616832.2

(51) Int. Cl.
*F01D 9/04* (2006.01)

(52) U.S. Cl. ..... 415/144; 415/199.5; 415/211.2; 415/912; 29/888.011; 29/888.021; 29/401.1; 29/889.22

(58) Field of Classification Search ..... 415/108, 415/199.4, 199.5, 144, 145, 211.2, 912; 29/888.011, 29/888.021, 888.01, 401.1, 889.22
See application file for complete search history.

(56) References Cited

U.S. PATENT DOCUMENTS

| | | | | |
|---|---|---|---|---|
| 4,221,114 | A | 9/1980 | Wilde et al. | |
| 6,783,321 | B2 * | 8/2004 | Lathrop et al. | 415/100 |
| 6,865,893 | B2 * | 3/2005 | Koganezawa et al. | 29/889.21 |
| 2003/0192516 | A1 | 10/2003 | Brunemann et al. | |
| 2005/0069411 | A1 * | 3/2005 | Bast et al. | 415/199.5 |
| 2005/0118025 | A1 | 6/2005 | Hiegemann et al. | |

FOREIGN PATENT DOCUMENTS

| | | | |
|---|---|---|---|
| DE | 628830 | C | 4/1936 |
| DE | 1038838 | B | 9/1958 |
| EP | 1055809 | A2 | 11/2000 |
| EP | 1055879 | B1 | 11/2000 |
| GB | 1116779 | A | 6/1968 |
| GB | 1258099 | A | 12/1971 |
| GB | 1362799 | A | 8/1974 |
| NL | 79228 | C | 6/1949 |
| WO | WO 03/060292 | A1 * | 7/2003 |

* cited by examiner

*Primary Examiner* — Christopher Verdier
(74) *Attorney, Agent, or Firm* — Volpe and Koenig, P.C.

(57) ABSTRACT

A steam turbine is provided that is configured for post-modification for operation in a carbon capture mode. The turbine includes a turbine rotor, a turbine casing and a plurality of turbine stages. In an initial configuration of the turbine, the turbine rotor and turbine casing are each longer, by respective lengths, than is necessary to accommodate the plurality of turbine stages. The lengths are sufficient to accommodate at least one further turbine stage at an exit of the turbine during the post-modification, such that after modification, the turbine operates with an increased expansion ratio and an increased volumetric flow rate at the exit.

13 Claims, 2 Drawing Sheets

STEAM TURBINES

CROSS REFERENCE TO RELATED APPLICATIONS

This application is a continuation of International Application No. PCT/EP2007/058772 filed Aug. 23, 2007, which claims priority to Great Britain Application No. 0616832.2 filed Aug. 25, 2006, the contents of both of which are incorporated by reference as if fully set forth.

FIELD OF INVENTION

The present invention relates to steam turbines, and in particular to steam turbines designed to facilitate later modification for operation with power plant incorporating carbon capture facilities.

BACKGROUND

Recently, there has been a growing consensus that global warming and resultant climatic change are serious threats to future socioeconomic stability. This has prompted interest in carbon capture and storage—so-called "carbon sequestration"—as a way of continuing to use fossil fuels without releasing carbon dioxide into the atmosphere. Unfortunately, carbon capture and sequestration technologies are not yet fully developed. Furthermore, designing power plants to capture the carbon they produce is likely to reduce their efficiency substantially. Consequently, most fossil-fuelled power-plants are still being built without provision for future carbon capture. It is therefore likely that governments will make regulations and/or provide incentives so that plants are designed for ease of retrofitting with carbon-capture equipment; i.e., they will be designed so that they are "carbon-capture ready".

Hitherto, steam turbines for power plants have normally been built to operate for their entire life on a particular thermodynamic cycle, as shown in German patent no. DE 628 830 C. However, depending on the carbon capture measures adopted, retrofitting of power plants with carbon capture equipment will necessitate modification of their steam turbines. An object of the present invention is therefore to provide steam turbines that are readily modifiable after design and manufacture to accommodate, at minimum expense, the demands of carbon-capture equipment added to the power generation plant at a later date.

SUMMARY

A steam turbine is provided that is configured to facilitate post-modification for operation in a carbon capture mode as part of a power plant incorporating carbon-capture facilities. The turbine includes a turbine rotor, a turbine casing and a plurality of turbine stages. In an original configuration of the turbine, the turbine rotor and turbine casing are each longer, by respective lengths, than is necessary to accommodate the plurality of turbine stages. The lengths are sufficient to accommodate at least one further turbine stage at an exit of the turbine during the post-modification, such that after modification, the turbine will operate with an increased expansion ratio and an increased volumetric flow rate at its exit.

The disclosure also deals with a power plant that is configured to facilitate post-modification for operation in a carbon capture mode as part of a power plant incorporating carbon-capture facilities. The power plant includes a steam turbine that has a turbine rotor, a turbine casing and a plurality of turbine stages. In an original configuration of the turbine, the turbine rotor and turbine casing are each longer, by respective lengths, than is necessary to accommodate the plurality of turbine stages. The lengths are sufficient to accommodate at least one further turbine stage at an exit of the turbine during the post-modification, such that after modification, the turbine will operate with an increased expansion ratio and an increased volumetric flow rate at its exit. The steam turbine is an intermediate pressure steam turbine operable to receive steam from a high pressure steam turbine and deliver steam to a low pressure steam turbine at a first volumetric flow rate.

The disclosure further deals with a carbon-capture-ready power plant that includes a boiler and a steam turbine having a plurality of stages. To facilitate post-construction modification of the power plant to incorporate a carbon capture process that requires process steam, the steam turbine is longer than is necessary to accommodate the plurality of turbine stages by an extra length sufficient to accommodate at least one further turbine stage at the exit of the turbine during the post-construction modification. After modification, the turbine is operable with an increased expansion ratio and an increased volumetric flow rate at its exit, thereby allowing steam to be bled from the turbine exit to supply the required process steam.

BRIEF DESCRIPTION OF THE DRAWINGS

Exemplary embodiments of the invention will now be described, with reference to the accompanying drawings, in which.

DETAILED DESCRIPTION OF THE PREFERRED EMBODIMENTS

Introduction to the Embodiments

Figure 1:
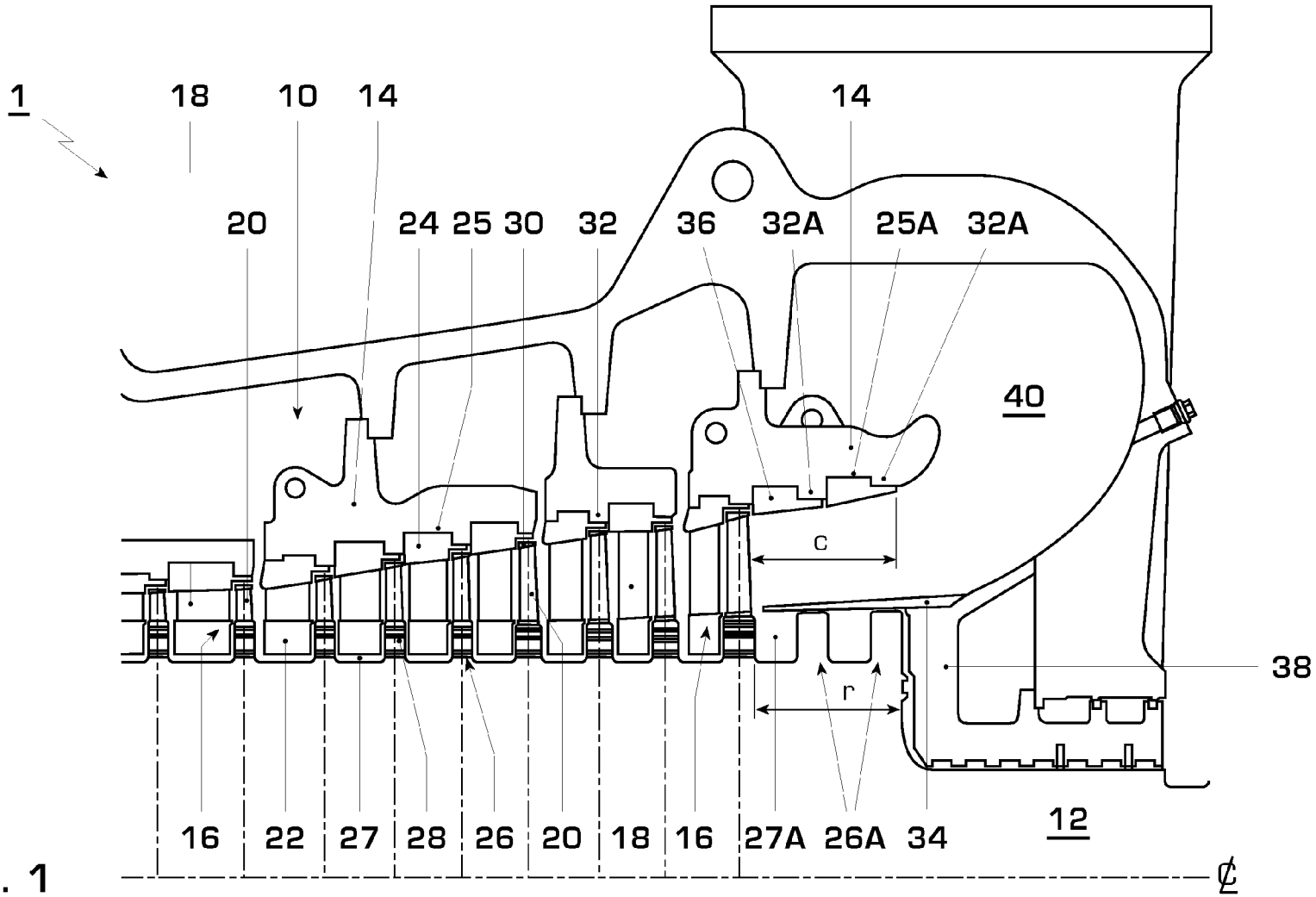
FIG. 1 illustrates a steam turbine according to the invention in its as-manufactured condition.

According to the present disclosure, a carbon-capture-ready power plant includes a boiler and a steam turbine comprising a plurality of stages, wherein to facilitate post-construction modification of the power plant to incorporate a carbon capture process that requires process steam, the steam turbine is longer than is necessary to accommodate the plurality of turbine stages by an extra length sufficient to accommodate at least one further turbine stage at the exit of the turbine during the post-construction modification, such that after modification, the turbine is operable with an increased expansion ratio and an increased volumetric flow rate at its exit, thereby allowing steam to be bled from the turbine exit to supply the required process steam.

Preferably, the extra length is sufficient to accommodate at least two further turbine stages at the exit of the turbine. The extra length may be at least partially pre-adapted to accommodate the extra stage(s).

It is envisaged that the steam turbine should be an intermediate pressure steam turbine operable to receive steam from a high pressure steam turbine and deliver steam to a low pressure steam turbine at a first volumetric flow rate. After modification, the intermediate pressure steam turbine will be operable to deliver process steam at a second volumetric flow rate while delivering steam to the low pressure steam turbine at the first volumetric flow rate.

The present disclosure further embraces a steam turbine constructed to facilitate later modification for operation in a carbon capture mode as part of a power plant incorporating carbon-capture facilities, the turbine comprising:

a turbine rotor;

a turbine casing; and a plurality of turbine stages;

wherein in an initial as-manufactured condition of the turbine, the turbine rotor and turbine casing are each longer—by respective lengths r and c—than is necessary to accommodate the plurality of turbine stages, the lengths r and c being sufficient to accommodate at least one further turbine stage at the exit of the turbine during the later modification, such that after modification, the turbine will operate with an increased expansion ratio and an increased volumetric flow rate at its exit.

Preferably, the extra lengths r and c are sufficient to accommodate at least two further turbine stages at the exit of the turbine. At the time of manufacture of the turbine, the extra lengths r and c of the turbine rotor and the turbine casing, respectively, may be adapted to accommodate the extra stage (s), or such adaptation may occur during the later modification of the turbine for carbon capture. It would of course be possible only partially to adapt the turbine rotor and the turbine casing at the time of manufacture and to complete the adaptation during later modification of the turbine.

Adaptation to accommodate the extra stage(s) may comprise features machined in the extra length r of the turbine rotor and/or the extra length c of the turbine casing to accommodate complementary features in the further turbine stage (s). In this case, a fairing should be provided on the turbine rotor and/or the turbine casing to avoid turbulence in the flow through the turbine due to the presence of unused features in the extra lengths of the turbine rotor and/or the turbine casing.

It should be understood that in a turbine according to the present invention, the prospective accommodation of extra turbine stages at some point in the future will necessitate appropriate dimensioning of other turbomachinery components during initial design and manufacture. Hence, the flow areas of the turbine casing and the turbine exit duct(s) must be designed to accommodate the largest volumetric flow rates that they will encounter after modification for carbon capture.

Each turbine stage in an axial flow turbine will comprise a fixed or stator blade and moving or rotor blade. The present invention is equally applicable to the disc and diaphragm type of turbine (so-called "impulse" turbines) and to the reaction type of turbine. In a reaction type of turbine, the static blades have outer portions fixed in the turbine casing and inner portions that sealingly confront the turbine rotor, the moving blades having root portions mounted in a drum-type turbine rotor and radially outer ends that sealingly confront the turbine casing. In a disc and diaphragm type of machine, inner and outer rings kinematically support the fixed blades, the outer rings being mounted in the turbine casing.

DETAILED DESCRIPTION

Briefly described, a preferred embodiment of the invention comprises a steam turbine for a carbon-capture ready fossil fuel power plant. The turbine includes an intermediate pressure (IP) turbine manufactured to operate with a particular expansion ratio and supply a low pressure turbine with a particular volumetric flow rate of steam. The IP turbine is manufactured with extra lengths in its rotor and casing to enable the later addition of extra turbine stages effective to increase the turbine's expansion ratio and volumetric flow rate at its exit without increasing its overall as-manufactured length. After addition of the extra stages, the resulting additional volumetric flow of process steam can be bled off from the exit of the IP turbine to service a post-combustion carbon-capture process, without affecting the ability of the IP turbine to supply the low pressure turbine with the original volumetric flow rate of steam.

Referring now to FIG. 1, an axial flow steam turbine 1 is part of a "carbon-capture ready" fossil fuel power generation plant, in which the turbine receives high pressure steam from a boiler, preferably at supercritical conditions for maximum plant efficiency. The steam is expanded successively through a high pressure (HP) turbine, not shown, an intermediate pressure (IP) turbine 10, and a low pressure (LP) turbine, not shown, all of which extract energy from the steam to drive an electrical generator, not shown, which is driven from the turbine rotor 12.

IP turbine 10 comprises, inter alia, a turbine rotor 12, a turbine casing 14 and a number of turbine blade stages 16. In this particular case there are nine turbine stages 16, but of course there could be more or less stages according to the design requirements.

Each IP turbine stage 16 comprises a fixed blade 18 and moving blade 20. In the present example, the turbine is constructed as a disc and diaphragm type of turbine (often called an impulse type of turbine) and hence the fixed blades 18 are kinematically supported by inner and outer rings 22, 24, respectively, each outer ring 24 being mounted in an annular recess 25 in the turbine casing 14 and each inner ring 22 occupying an annular chamber 27 between successive disc rim or "head" portions 26 of the rotor 12 (divisions between individual discs are not shown, since the discs have been welded together during the rotor manufacturing process so that the rotor is a single unit). The radially inner surfaces of the inner rings 22 sealingly confront portions of the outer rotor surface that lie between the disc head portions 26. As well known in the industry, labyrinth seals, brush seals, or the like (not shown), may be provided to seal the gaps between the inner rings 22 and the rotor surface. Regarding the moving blades 20, in this particular design they have root portions 28 that are fixed to the disc rim portions 26 of the rotor 12 by a pinned root arrangement, as is also well known. The tips of the moving blades 20 are provided with shroud or cover portions 30, whose outer surfaces sealingly confront corresponding lands 32 on the turbine casing 14. Again, labyrinth seals, brush seals, or the like (not shown), may be provided to seal the gaps between the shrouds 30 and the lands 32.

As will be evident from FIG. 1, in the as-manufactured condition of the turbine 1, the turbine rotor 12 and turbine casing 14 are each longer—by respective lengths r and c—than is necessary to accommodate the nine turbine stages shown. In fact, the lengths r and c are, in the present example, sufficient to accommodate two further turbine stages during later modification of the turbine. Stated another way, the turbine is longer than is necessary for accommodating the number of turbine stages shown in FIG. 1 by an extra length that is sufficient to accommodate the further turbine stages that would render it suitable for operating in a "carbon capture" mode, as explained later.

As can be seen from FIG. 1, the turbine rotor 12 has been adapted to accommodate the extra stages at the time of its manufacture, in that that features have been pre-machined into the extra lengths r and c of the turbine rotor 12 and the turbine casing 14 to accommodate complementary features on the extra turbine stages. Specifically, disc head portions 26A and annular chambers 27A have been machined into the extra length r of the rotor. Similarly, sealing lands 32A and intervening recesses 25A have been machined into the extra length c of the casing. Nevertheless, although complete pre-adaptation of the extra lengths of the turbine rotor and the turbine casing to receive the extra stages would be possible, they have been only partially adapted. For example, the additional disc head portions 26A have not been final machined to accept the pinned root portions of the extra moving blades. Therefore, in this particular embodiment, adaptation for the extra turbine stages must be completed during later modification of the turbine.

Additional characteristics of the turbine of FIG. 1 in its as-manufactured condition should be noted. It will be evident to the skilled person that full or partial pre-adaptation of the rotor 12 and casing 14 to receive the eventual extra stages requires the provision of removable fairings or the like to avoid excessive turbulence in the flow through the turbine. Such turbulence would otherwise be produced by unused features such as the chambers 27A and the recesses 25A in the extra lengths r and c of the turbine rotor and the turbine casing. In FIG. 1, such fairings take the form of an inner diffuser ring 34, which fairs in the disc head portions 26A and chambers 27A of rotor 12, and outer diffuser rings 36, which fair in the recesses 25A and lands 32A of casing 14. The inner diffuser ring 34 is fixed to static structure 38 of the turbine 10, but could alternatively be fixed to the rotor. However, fixing to the static structure is preferred, because no extra adaptation of the rotor periphery is necessary and the diffuser ring 34 does not have to be designed to take rotational stresses.

In an alternative embodiment (not shown), adaptation of the rotor and casing necessary to accommodate the extra stages is deferred until modification for carbon capture becomes necessary. Hence, in this alternative embodiment, the extra lengths r and c would appear plain, being machined down only to the rotor outer profile and the casing inner profile, respectively. To avoid completely the need for separate inner and outer diffuser rings acting as fairings, it would be possible to machine the extra lengths r and c of the rotor and stator so that the rotor's outer profile and the casing's inner profile comprise the necessary diffusing profiles of the turbine exit.

Figure 2:
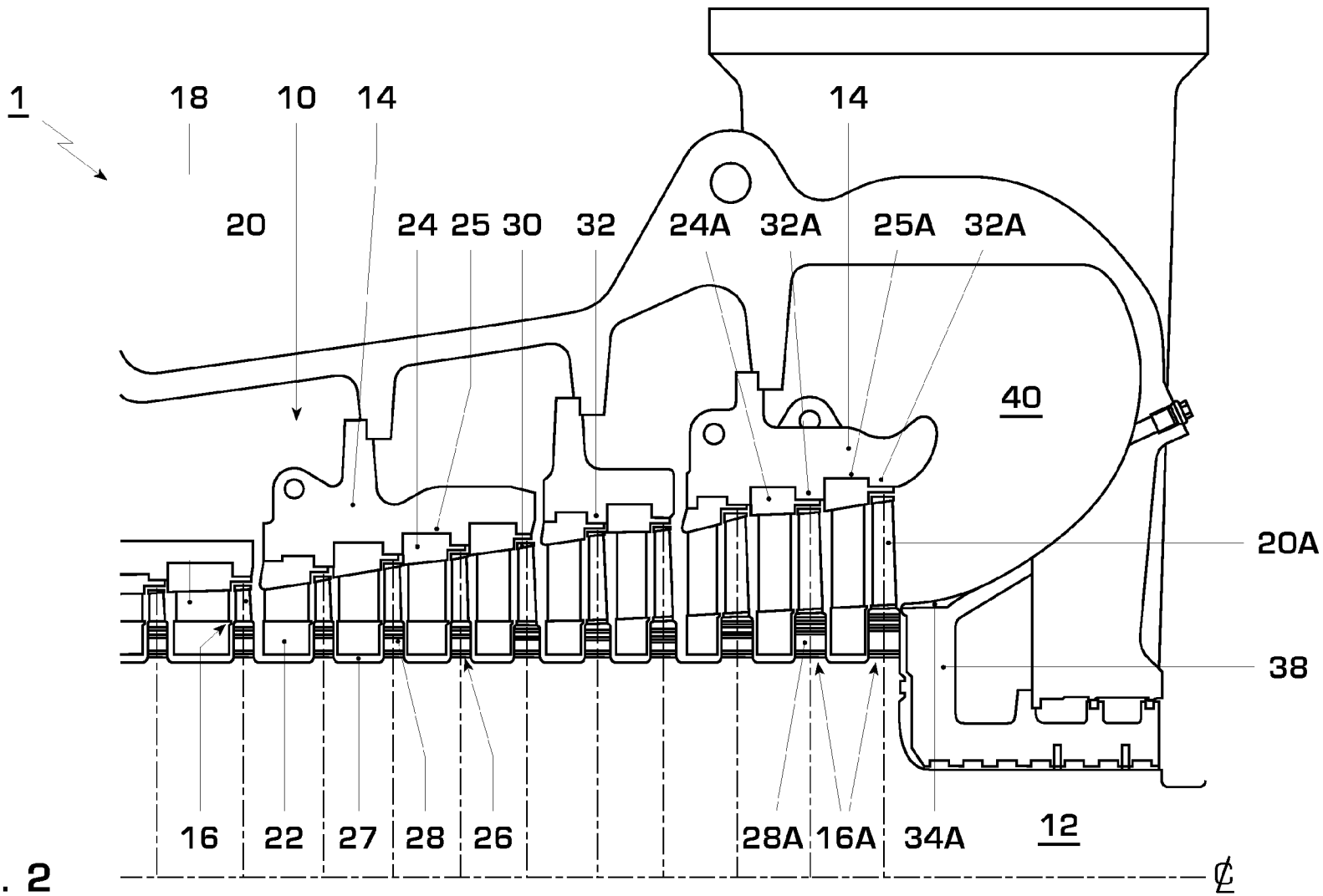
FIG. 2 illustrates the same turbine after later modification to achieve a different thermodynamic cycle more suited to operation in conjunction with carbon-capture facilities.

FIG. 2 shows the turbine 1 as modified for carbon capture by the addition of two extra turbine stages 16A. The large inner diffuser ring 34 shown in FIG. 1 has been removed and replaced by a small ring 34A to maintain the profile of the turbine exit duct 40. The disc head portions 26A have been finish-machined to accommodate the pinned root portions 28A of the moving blades 20A in the extra turbine stages 16A. The outer diffuser rings 36, 37 of FIG. 1 have also been removed and replaced by the outer rings 24A of the two additional diaphragms.

Whereas the above description with reference to FIGS. 1 and 2 has concentrated on providing a turbine construction which is readily modifiable to alter its thermodynamic cycle for carbon capture purposes, it should also be understood that the prospective accommodation of extra turbine stages will necessitate appropriate dimensioning of other turbomachinery components during initial design and manufacture. For example, the flow areas of the turbine casing 14 and the turbine exit duct 40 must be designed to accommodate the largest volume flow rates that they will encounter after modification for carbon capture.

Referring back to FIG. 1, the requirement to be carbon-capture ready means that the power plant is designed so that at a date some time after its construction, when large-scale carbon-capture technology is sufficiently developed and required to be fitted, a suitable post-combustion carbon-capture process can be added to the plant at minimum expense. Among other things, this requires the addition of a carbon dioxide scrubber downstream of the boiler that produces the steam for the steam turbine 1. Such scrubbers require large mass-flow rates of pressurised process steam, which can be provided by bleeding steam from the IP turbine exit duct 40, before the inlet to the LP turbine. This explains the need to design the IP turbine 10 so that it has enough capacity to accommodate the largest volume flow rate it is likely to handle after modification of the plant for carbon capture. Hence, before modification of the power plant, the IP turbine 10 will operate below its maximum volumetric flow rate at its exit, with a volumetric flow rate and an expansion ratio matched to the inlet capacity and pressure of the following LP turbine. After modification, although the mass flow at the IP turbine exhaust remains fairly constant, the mass flow to the LP inlet will drop significantly since a proportion of the IP exhaust flow is extracted to the carbon capture plant. This results in a reduction in IP exhaust pressure and hence an increase in volumetric flow at the IP turbine exhaust. This will require the IP turbine to operate with an increased expansion ratio. In the present embodiment, the increased expansion ratio is accommodated by adding two extra turbine stages 16A. After the process steam has been bled off from the outlet of the IP turbine, the volumetric flow rate into the LP turbine inlet will equal its original design capacity.

It should be understood that provision for the addition of two turbine stages in FIGS. 1 and 2 is only an example. The actual number of extra stages required will depend upon the mass flow rate of process steam required for carbon capture, which in turn will depend upon the size of the power plant and the parameters of the specific carbon capture system chosen.

Although FIGS. 1 and 2 illustrate a turbine of the disc and diaphragm or impulse type, the invention can equally be applied to reaction-type turbines, in which outer portions of the static blades are fixed directly in the turbine casing and the roots of the moving blades are mounted in grooves on a drum-type rotor.

Several advantages are achievable by the present invention:

- the turbine has optimal performance both before and after modification;
- cost of modification is minimised;
- the number of components that must be scrapped during modification is minimised;
- lifetime economics of the plant are improved relative to a plant that is not provided with a carbon-capture ready turbine from the beginning.

The present invention has been described above purely by way of example, and modifications can be made within the scope of the invention as claimed. The invention also consists in any individual features described or implicit herein or shown or implicit in the drawings or any combination of any such features or any generalisation of any such features or combination, which extends to equivalents thereof. Thus, the breadth and scope of the present invention should not be limited by any of the above-described exemplary embodiments. Each feature disclosed in the specification, including the claims and drawings, may be replaced by alternative features serving the same, equivalent or similar purposes, unless expressly stated otherwise.

Unless the context clearly requires otherwise, throughout the description and the claims, the words "comprise", "comprising", and the like, are to be construed in an inclusive as opposed to an exclusive or exhaustive sense; that is to say, in the sense of "including, but not limited to".

What is claimed is:

1. A steam turbine configured for post-modification for operation in a carbon capture mode, the turbine comprising:

a turbine rotor;

a turbine casing; and a plurality of turbine stages;

wherein in an initial configuration of the turbine, the turbine rotor and turbine casing are each longer—by respective lengths r and c—than is necessary to accommodate the plurality of turbine stages, the lengths r and c accommodating at least one further turbine stage at an exit of the turbine during the post-modification, wherein after modification, the turbine accommodates the at least one further turbine stage and operates with an increased expansion ratio and an increased volumetric flow rate at the exit.

2. A steam turbine according to claim 1, wherein lengths r and c are sufficient to accommodate at least two further turbine stages at the exit of the turbine.

3. A turbine according to claim 1,wherein in the initial configuration of the turbine, lengths r and c of the turbine rotor and the turbine casing, respectively, are at least partially configured to accommodate the at least one further stage.

4. A turbine according to claim 3, wherein adaptation to accommodate the at least one further stage comprises features machined in at least one of the length r of the turbine rotor or the length c of the turbine casing to accommodate complementary features in the at least one further turbine stage.

5. A turbine according to claim 4, wherein a fairing is provided on at least one of the turbine rotor or the turbine casing to avoid turbulence in the flow through the turbine due to the presence of unused features in the lengths of at least one of the turbine rotor or the turbine casing.

6. A power plant comprising a steam turbine configured for post-modification for operation in a carbon capture mode, the turbine comprising: a turbine rotor; a turbine casing; and a plurality of turbine stages; and in an initial configuration of the turbine, the turbine rotor and turbine casing are each longer—by respective lengths r and c—than is necessary to accommodate the plurality of turbine stages, the lengths r and c accommodating at least one further turbine stage at an exit of the turbine during the post-modification, wherein after modification, the turbine accommodates the at least one further turbine stage and operates with an increased expansion ratio and an increased volumetric flow rate at the exit, wherein the steam turbine is an intermediate pressure steam turbine operable to receive steam from a high pressure steam turbine and deliver steam to a low pressure steam turbine at a first volumetric flow rate.

7. A power plant according to claim 6, wherein, after modification, the intermediate pressure steam turbine is operable to deliver process steam at a second volumetric flow rate while delivering steam to the low pressure steam turbine at the first volumetric flow rate.

8. A carbon-capture-ready power plant including a boiler and a steam turbine comprising a plurality of stages, wherein for post-construction modification of the power plant to incorporate a carbon capture process that requires process steam, the steam turbine has a length that is longer than is necessary to accommodate the plurality of turbine stages by an extra length accommodating at least one further turbine stage at an exit of the turbine during the post-construction modification, wherein after modification, the turbine accommodates the at least one further stage and is operable with an increased expansion ratio and an increased volumetric flow rate at its exit, thereby allowing steam to be bled from the turbine exit to supply the required process steam.

9. A power plant according to claim 8, wherein the extra length is sufficient to accommodate at least two further turbine stages at the exit of the turbine.

10. A power plant according to claim 8, wherein the extra length at least partially accommodates the at least one further stage.

11. A power plant according to claim 8, wherein the steam turbine is an intermediate pressure steam turbine operable to receive steam from a high pressure steam turbine and deliver steam to a low pressure steam turbine at a first volumetric flow rate.

12. A power plant according to claim 11, wherein, after modification, the intermediate pressure steam turbine is operable to deliver process steam at a second volumetric flow rate while delivering steam to the low pressure steam turbine at the first volumetric flow rate.

13. A method for modifying a steam turbine, for post-modification operation in a carbon capture mode, the method comprising:

providing a steam turbine with a plurality of turbine stages, wherein in an initial configuration of the turbine, the turbine rotor and turbine casing are each longer—by respective lengths r and c—than is necessary to accommodate the plurality of turbine stages; and modifying the steam turbine by adding at least one further stage at an exit of the turbine so as to enable an expansion ratio of the steam turbine to be increased and a volumetric flow rate at the exit of the steam turbine to be increased.

* * * * *